United States Patent [19]

Blanken

[11] 4,403,169

[45] Sep. 6, 1983

[54] CATHODE SUSPENSION MEANS FOR CATHODE RAY TUBE ELECTRON GUN

[75] Inventor: Jacob Blanken, Eindhoven, Netherlands

[73] Assignee: U.S. Philips Corporation, New York, N.Y.

[21] Appl. No.: 256,348

[22] Filed: Apr. 22, 1981

[30] Foreign Application Priority Data

Apr. 23, 1980 [NL] Netherlands ..... 8002343

[51] Int. Cl.[3] ..... H01J 29/46

[52] U.S. Cl. ..... 313/446; 313/456

[58] Field of Search ..... 313/446, 38, 456, 270, 313/337

[56] References Cited

U.S. PATENT DOCUMENTS 2,411,046 12/1946 Liimatainen ..... 313/38

3,983,442 9/1976 Jariwala et al. ..... 313/456 X 4,297,612 10/1981 Anezaki ..... 313/446

*Primary Examiner*—Palmer C. Demeo

*Assistant Examiner*—Sandra L. O'Shea

*Attorney, Agent, or Firm*—Robert J. Kraus

[57] ABSTRACT

An electron gun for generating an electron beam, comprising a cathode unit composed of at least a cylindrical cathode shaft having an end surface which forms an emissive surface. The cathode shaft is surrounded at least partly by a cylindrical metal heat reflection screen which extends beyond the open end of the cathode shaft. The cathode shaft and the heat reflection screen are secured in a cathode support, wherein the cathode shaft is suspended in the heat reflection screen so as to be self-supporting by means of metal strips or wires which are secured to the cathode shaft near the emissive surface and to the cathode support. This arrangement increases thermal efficiency and decreases warm-up time.

8 Claims, 10 Drawing Figures

CATHODE SUSPENSION MEANS FOR CATHODE RAY TUBE ELECTRON GUN

BACKGROUND OF THE INVENTION

The invention relates to an electron gun for generating an electron beam, comprising a cathode unit composed of at least a cylindrical cathode shaft having an end surface which forms the emissive surface. The cathode shaft is surrounded coaxially at least partly by a cylindrical metal heat reflection screen extends around and beyond the open end of the cathode shaft. The cathode shaft and the heat reflection screen are secured in a cathode support.

The invention also relates to a cathode-ray tube comprising such an electron gun.

Such electron guns are used in black-and-white and colour display tubes for television and for data display, in camera tubes and other tubes in which an electron beam is to be generated.

A cathode unit of the construction described in the opening paragraph is disclosed in German Patent Application Ser. No. 1,764,047 laid open to public inspection. The construction described in this Patent Application comprises a cathode shaft which near its open end is secured to a heat reflection screen by means of spot-welding. This heat reflection screen surrounds the cathode shaft coaxially and extends beyond the open end thereof. The heat reflection screen in turn is secured in a cathode support by means of metal strips. As a result of the reflection of heat originating from the cathode shaft back to said cathode shaft by means of a heat reflection screen which preferably is polished on its inside, the efficiency of the cathode is increased.

However, such a construction also has a few disadvantages. Because the cathode shaft is secured near the open end of the heat reflection screen, the emissive surface will during warm-up of the cathode shaft and the resulting thermal expansion, move in the axial direction, which is not desired, as will be explained hereinafter. Moreover, heat will flow from the cathode shaft to the heat reflection screen via the spot-welds and will warm-up said screen. The heat radiated by the heat reflection screen on its outside reduces the efficiency of the system. The warm-up time of the cathode is long as a result of the large heat capacity of the system.

SUMMARY OF THE INVENTION

It is therefore an object of the invention to provide an electron gun having a cathode unit with an improved efficiency and a warm-up time which does not have the above-mentioned disadvantages.

According to the invention, an electron gun of the kind mentioned in the opening paragraph is characterized in that the cathode shaft is suspended in the heat reflection screen so as to be self-supporting (freely suspended) by means of metal strips or wires which are secured to the cathode shaft near the emissive surface and to the cathode support. Since the cathode shaft is suspended in the heat reflection screen so as to be self-supporting, without any supporting point or contact point in the heat reflection screen, no heat is transferred by conduction to the heat reflection screen, so that the efficiency of the cathode unit is increased. The efficiency of such a cathode is 1.3× larger than without the use of the heat reflection screen. Expansion of the cathode shaft has substantially no effect on the location of the emissive surface. The cathode shaft will only extend further into the heat reflection screen. The expansion of the strips or wires is negligible. The shape of the cathode support is not essential. The cathode support preferably comprises a disk of insulation material having a central aperture in which a cathode supporting cylinder is secured from which the cathode shaft and the heat reflection screen are suspended. A preferred embodiment of an electron gun according to the invention is characterized in that the end of the cathode supporting cylinder remote from the emissive surface is closed by a metal plate having a central aperture in which the heat reflection screen is provided coaxially. However, it is also possible to secure the heat reflection screen in the cathode supporting cylinder by means of rods or strips.

The cathode shaft is preferably suspended in the heat reflection screen coaxially so as to be self-supporting by means of the metal strips or wires which are secured to the cathode shaft near the emissive surface and which are secured to the metal plate with their other ends. As a result of this the metal strips or wires become even longer so that they have a larger overall resistance to thermal conductivity and the efficiency of the construction becomes even larger.

By providing the metal plate with a deepened central portion, if desired, the length of the cathode supporting cylinder can be selected at will.

It is also possible for the heat reflection screen to be provided coaxially in an aperture in a metal plate in which at least two other apertures supporting pins are provided by means of insulation material so as to be electrically insulated. For example, the metal wires or strips for the cathode shaft suspension or the connection strips for the heating wire of the cathode can be secured to said supporting pins. It is possible to secure the cathode and the heat reflection screen in the electron gun by means of such a metal plate. In that case the metal plate is the cathode support.

The efficiency of the cathode unit can be still further improved by closing the opposite end of the cathode supporting cylinder by a cover plate, which cover plate comprises a central aperture through which extends the part of the cathode shaft comprising the emissive surface.

It has also possible to obtain a cathode unit having a high efficiency when in an electron gun in accordance with the invention the end of the heat reflection screen situated in the elongation of the open end of the cathode shaft is at least partly closed.

BRIEF DESCRIPTION OF THE DRAWING

The invention will now be described in greater detail with reference to the drawing, in which.

DESCRIPTION OF THE PREFERRED EMBODIMENTS

Figure 1:
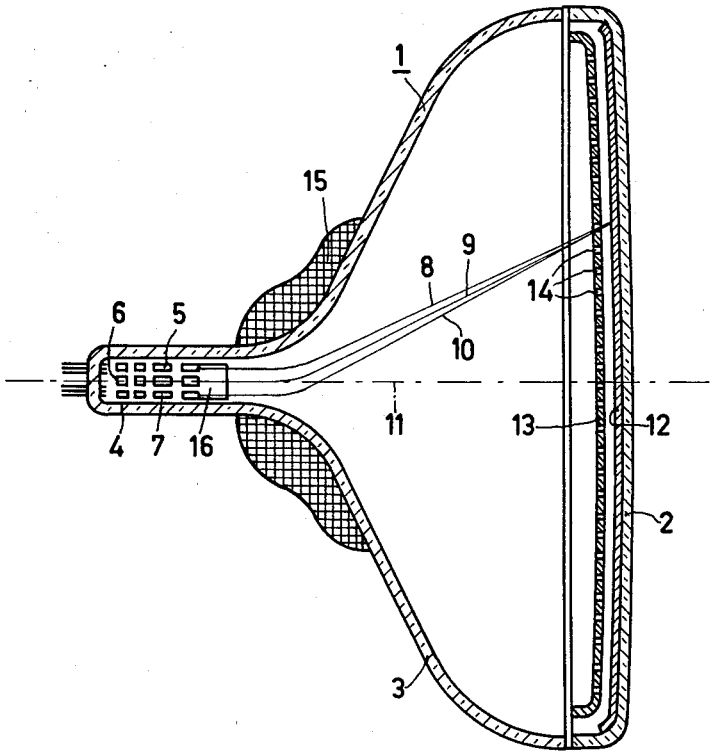
FIG. 1 is a sectional view of a cathode-ray tube including an electron gun according to the invention.

FIG. 1 is a sectional view of a cathode-ray tube according to the invention, in this case a colour display tube of the "in-line" type. The invention may also be used in camera tubes, black-and-white television display tubes, and other types of tube in which an electron beam is to be generated. In a glass envelope 1 which is composed of a display window 2, a funnel-like portion 3 and a neck 4, three electron guns 5, 6 and 7 are provided in said neck for generating electron beams 8, 9 and 10, respectively. The axes of the electron guns are situated in one plane, the plane of the drawing. The axis of the central electron gun 6 coincides substantially with the tube axis 11. The three electron guns open into a sleeve 16 which is situated coaxially in the neck 4. The display window has on its inside a large number of triplets of phosphor lines. Each triplet comprises a line consisting of a green-luminescing phosphor, a line consisting of a blue-luminescing phosphor and a line consisting of a red-luminescing phosphor. All triplets together constitute the display screen 12. The phosphor lines extend at right angles to the plane of the drawing. A shadow mask 13 comprising a very large number of elongate apertures 14 through which the electron beams 8,9 and 10 emanate is provided in front of the display screen. The electron beams are deflected by the system of deflection coils 15 in a horizontal direction (in the plane of the drawing) and in the vertical direction (at right angles to the plane of the drawing). The three electron guns are mounted so that the axes thereof enclose a small angle with each other. As a result of this the electron beams fall through the apertures 14 at that angle, the so-called colour selection angle, and each impinges only on phosphor lines of a respective colour.

Figure 2:
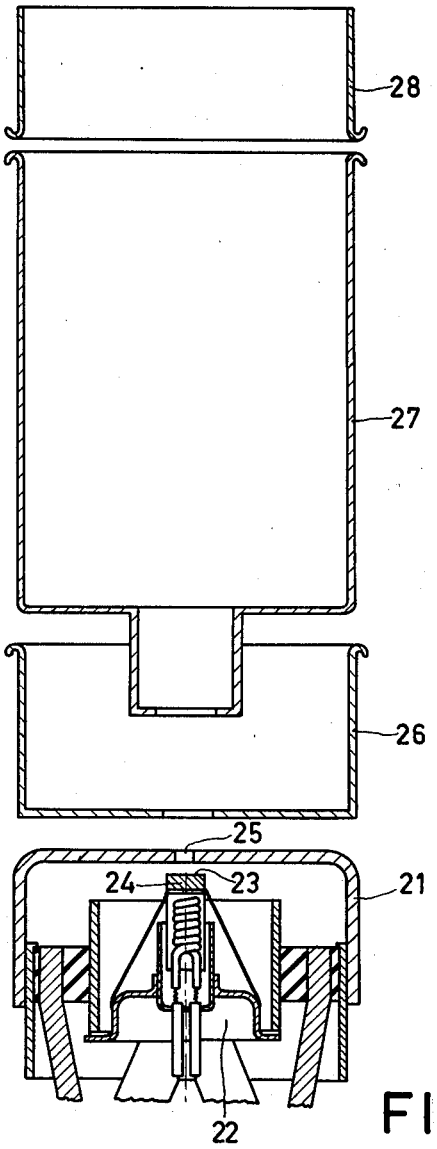
FIG. 2 is a sectional view of an electron gun according to the invention.

FIG. 2 is a longitudinal sectional view of one of the electron guns. A cathode unit 22 is positioned in the grid 21. The emissive surface 23 of the cathode consists of a thin surface layer emitter on an impregnated tungsten emitter body 24. The electron beam generated passes through an aperture 25 in the first grid 21 and is then accelerated and focused by means of the electrodes 26, 27 and 28. In a colour display tube the cathode potential is, for example, +30 volts, the first grid has a potential of, for example 0 volts and the second grid 26 has a potential of 1000 volts, the thrid grid has a potential of 6000 volts and the fourth grid 28 has a potential of 27 kV. The operation of the first grid electrode 21 depends on the distance from the emissive surface 23 to said electrode. Expansion of the cathode shaft may have no influence the cathode grid-1 distance. Such a cathode unit may, of course, also be used in a diode electron gun (for example, in television camera tubes). In a diode electron gun the cathode is succeeded by an anode which is at a positive voltage. In such a diode electron gun the distance from the cathode to the anode must remain constant.

Figure 3:
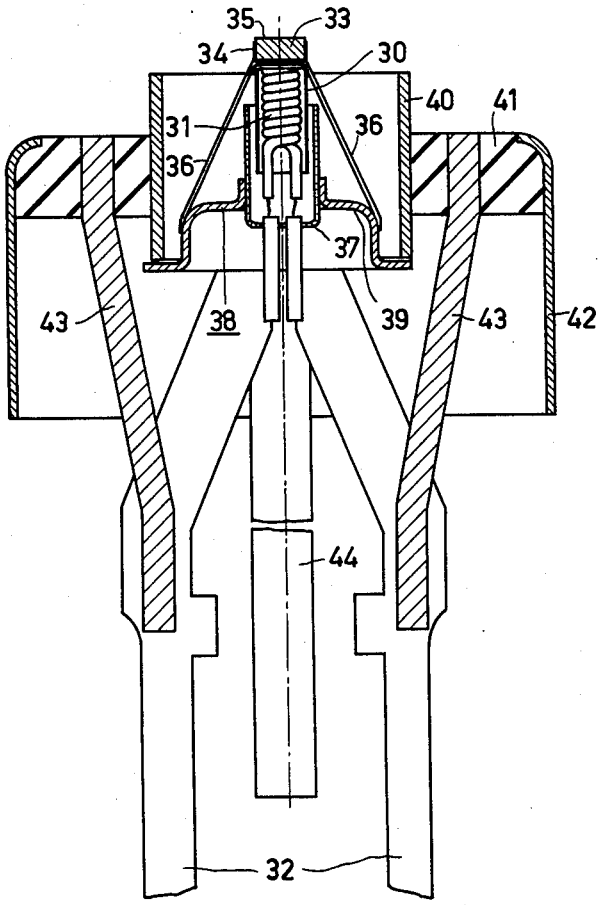
FIG. 3 shows a detail of FIG. 2, FIGS. 4 and 5 are sectional views of alternative embodiments of the cathode unit for an electron gun in accordance with the invention.

FIG. 3 shows the cathode unit as used in the electron gun of FIG. 2. It comprises a heating wire 31 which is covered with blackened aluminium oxide and is connected to the connection strips 32. The end face of the cathode shaft 30 comprises an impregnated tungsten body 33 in a holder 34 and having emissive surface 35. According to the invention, the cathode shaft 30 is suspended in the heat reflection screen 37 so as to be self-supporting by means of metal wires 36. There exist no direct contact points between the cathode shaft 30 and the heat reflection screen 37 which might result in thermal conductivity and hence loss of efficiency of the cathode unit. The metal wires 36 consist of tungsten-Rhenium and have a diameter of 0.05 mm. In this construction the length of the wires is approximately 2.5 mm. The temperature gradient in the wires is largest near the cathode shaft. The wires are comparatively poor conductors and hence little thermal loss will occur via the wires. The heat reflection screen 37 is secured to a cathode supporting cylinder 40 by means of a metal plate 38 having a deepened central portion 39. The connection of the heat reflection screen 37 in plate 38 is preferably done by means of only a few spotwelds (made, for example, by means of a laser) so as to make the heat contact as bad as possible. The cathode supporting cylinder 40 is surrounded by an electrically insulating ceramic body 41 in an assembly cylinder 42. Two pins 43 to which the connection strips 32 for the heating wire 31 are spot-welded are provided in the ceramic body. Moreover, a cathode connection strip 44 is present at the cathode unit.

Figure 4:
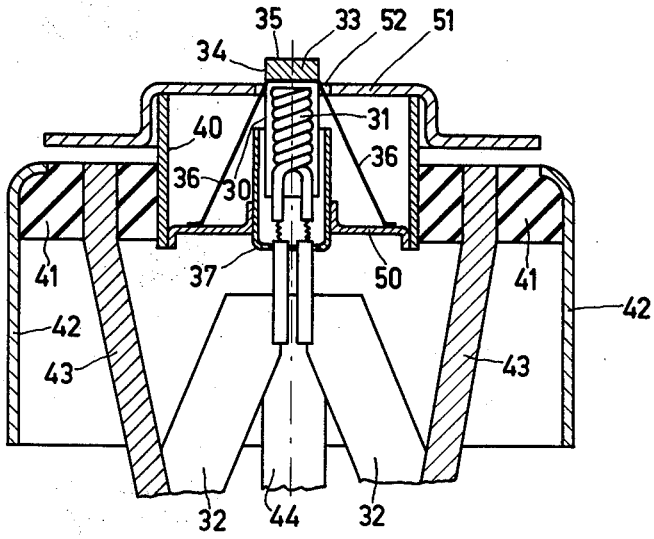

FIG. 4 is a sectional view of another embodiment of a cathode unit for an electron gun according to the invention. The difference from the FIG. 3 embodiment is that the connection plate 50 for the connection of the heat reflection screen has no deepened portion. The cathode supporting cylinder may in that case be chosen to be shorter. Moreover, the cathode unit has a cover plate 51 comprising a central aperture 52 through which the cathode shaft with tungsten body 33 projects. The cover plate 51 ensures that even less thermal energy is lost. The components not yet referred to have already been mentioned in the FIG. 3 embodiment.

Figure 5:
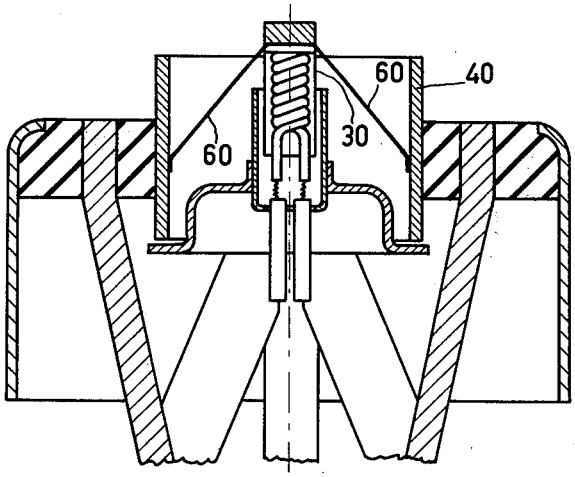

The embodiment shown in FIG. 5 differs from the FIG. 3 embodiment only in the connection of the cathode shaft 30 by means of the wires 60 directly to the cathode supporting cylinder 40. The other components shown have already been described with reference to FIG. 3.

Figure 6:
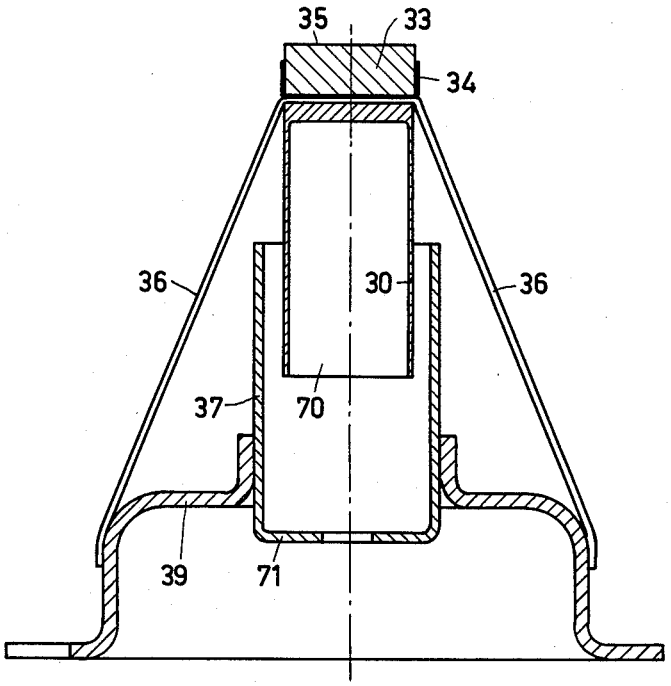
FIG. 6 shows a detail of FIG. 3.

FIG. 6 shows a detail of FIG. 3. By closing the heat reflection screen 37 at the end situated in the elongation of the open end 70 of the cathode shaft 30 at least partly, for example, by means of an inwardly bent rim 71, the thermal energy radiated from the open end of the cathode shaft is also reflected so that the thermal energy is not lost. As a result of this the efficiency of the cathode unit is also improved. This end of the heat reflection screen can also be closed by means of a plate having one central aperture or having two apertures through which the ends of the heating wire emanate.

Figure 7:
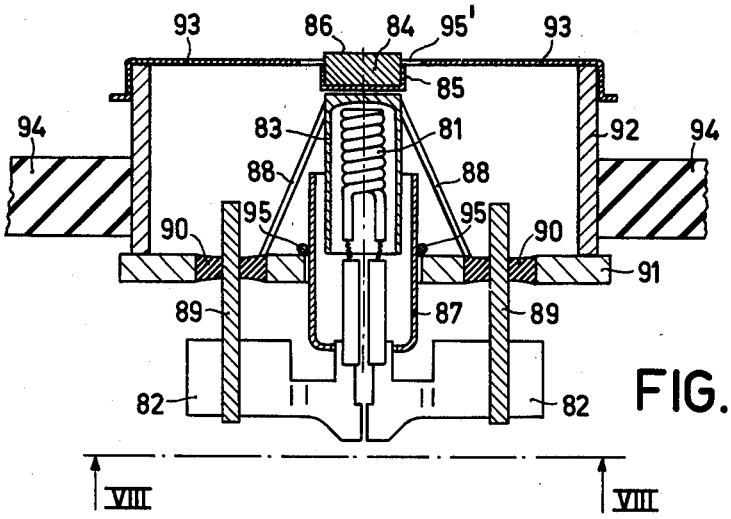
FIG. 7 is a sectional view of an alternative embodiment of a cathode unit for an electron gun in accordance with the invention.

FIG. 7 is a sectional view of another embodiment of a cathode unit for an electron gun according to the invention. It comprises a heating wire 81 which is covered with blackened aluminium oxide and which is connected to the connection strips 82. The end face of the cathode shaft 83 has an impregnated tungsten body 84 in a holder 85 and with emissive surface 86. According to the invention the cathode shaft 83 is suspended in the cylindrical heat reflection screen 87 so as to be self-supporting by means of wires 88. There are no direct contact points between the cathode shaft 83 and the heat reflection screen 87 which might result in thermal conduction to the heat reflection screen. The connection strips 82 in turn are welded to supporting pins 89 which are fixed in apertures in a metal plate 91 by means of glass plugs 90. The heat reflection screen 87 is also connected in a central aperture in plate 91, preferably by means of two spot-welds 95. In this case the plate 91 is connected against one end of a cathode supporting cylinder 92 which is connected in the electron gun by means of a glass ring 94. At its other end the cathode supporting cylinder is closed by means of a cover plate 93 having a central aperture 95 through which the tungsten body 84 extends. However, it is also possible to use plate 91 for assembly in the electron gun so that the cathode supporting cylinder is superfluous. The wires 88 are secured to plate 91. However, it is also possible to connect these wires to supporting pins which are secured to plate 91 in a similar manner as the supporting pins 89.

Figure 8:
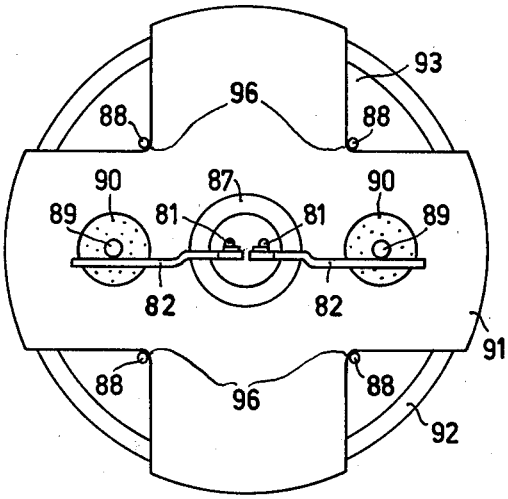
FIG. 8 is a bottom view of FIG. 7.

FIG. 8 is a bottom view of FIG. 7. Plate 91 does not close the cathode supporting cylinder 92 entirely and is cross-shaped. The wires 88 are welded in the corners 96 of the cross.

Figure 9:
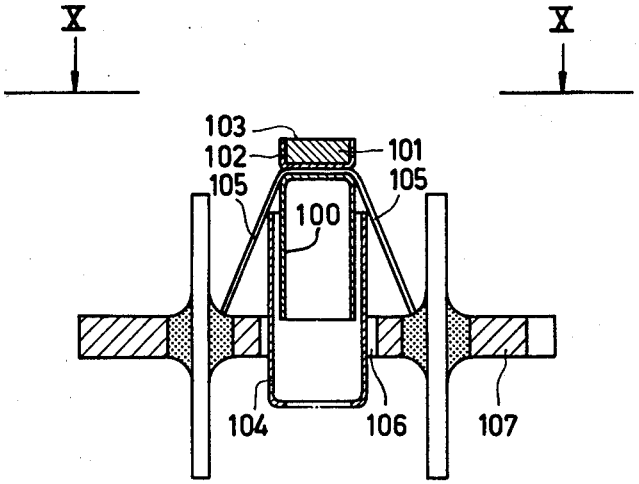
FIG. 9 is a sectional view of another alternative embodiment of a cathode unit for an electron gun in accordance with the invention.

FIG. 9 is a sectional view of another alternative embodiment of a cathode unit for an electron gun in accordance with the invention. The end face of the cathode shaft 100 has an impregnated tungsten body 101 in a holder 102 and with an emissive surface 103. The heating wire in this embodiment is not shown. According to the invention, the cathode shaft 100 is suspended in the cylindrical heat reflection screen 104 so as to be self-supporting by means of wires 105. Direct contact points which might result in thermal conductivity towards the heat reflection screen do not exist between the cathode shaft 100 and the heat reflection screen 104. The heat reflection screen 104 is fixed in a central aperture 106 in the metal sheet 107.

Figure 10:
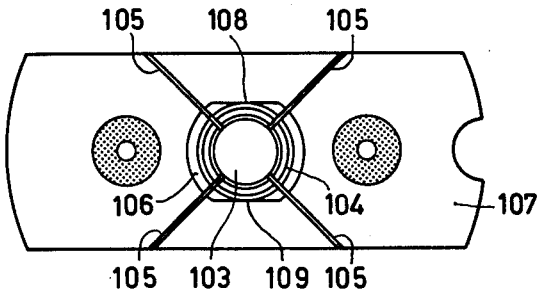
FIG. 10 is a plan view of FIG. 9.

As shown in FIG. 10, the aperture 106 has such a shape that the edge of the aperture touches the heat reflection screen only in two places 108 and 109. In these two places the heat reflection screen is secured to the sheet 107 by means of two spotwelds.

What is claimed is:

1. An electron gun for generating an electron beam, comprising a cathode unit including a cylindrical cathode shaft having an end which forms an emissive surface, said cathode shaft being surrounded at least an end remote from the emissive surface by a cylindrical metal heat reflection screen which extends beyond said remote end of the cathode shaft, said cathode shaft and heat reflection screen being secured in a cathode support, characterized in that the cathode shaft is suspended in the heat reflection screen by means of metal strips or wires which are secured to the cathode shaft near the emissive surface and to the cathode support.

2. An electron gun as claimed in claim 1, characterized in that the cathode support comprises a disk of insulation material having a central aperture in which a cathode supporting cylinder is connected, said cathode shaft and heat reflection screen being secured to said cathode supporting cylinder.

3. An electron gun as claimed in claim 2, characterized in that the end of the cathode supporting cylinder remote from the emissive surface is closed by means of a metal plate which has a central aperture in which the heat reflection screen is coaxially disposed.

4. An electron gun as claimed in claim 3, characterized in that the cathode shaft is suspended coaxially in the heat reflection screen by means of the metal strips or wires, each of which has one end secured to the cathode shaft near the emissive surface and has the other end secured to the metal plate.

5. An electron gun as claimed in claim 3 or 4, characterized in that the metal plate has a deepened central portion.

6. An electron gun as claimed in claim 1 or 2, characterized in that said cathode support includes a metal plate having an aperture in which the heat reflection screen is provided, said metal plate having at least two other apertures containing insulating material in which supporting pins are provided.

7. An electron gun as claimed in claim 2, 3 or 4, characterized in that the end of the cathode supporting cylinder nearest the emissive surface is closed by means of a cover plate, said cover plate comprising a central aperture through which the part of the cathode shaft having the emissive surface extends.

8. An electron gun as claimed in claim 1, 2, 3 or 4, characterized in that the end of the heat reflection screen remote from the emissive surface is at least partly closed.

* * * * *

UNITED STATES PATENT AND TRADEMARK OFFICE

CERTIFICATE OF CORRECTION

PATENT NO. : 4,403,169

DATED : September 6, 1983

INVENTOR(S) : JACOB BLANKEN

It is certified that error appears in the above—identified patent and that said Letters Patent is hereby corrected as shown below:

Claim 1, line 4, delete "least".

Signed and Sealed this

*Fifteenth* Day of *May 1984*

[SEAL]

*Attest:*

GERALD J. MOSSINGHOFF

*Attesting Officer*

*Commissioner of Patents and Trademarks*